US010900326B2

(12) United States Patent
Patel

(10) Patent No.: US 10,900,326 B2
(45) Date of Patent: Jan. 26, 2021

(54) BACK FLOW RESTRICTION SYSTEM AND METHODOLOGY FOR INJECTION WELL

(71) Applicant: SCHLUMBERGER TECHNOLOGY CORPORATION, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/248,871

(22) Filed: Jan. 16, 2019

(65) Prior Publication Data

US 2019/0218887 A1 Jul. 18, 2019

Related U.S. Application Data

(60) Provisional application No. 62/617,926, filed on Jan. 16, 2018.

(51) Int. Cl.

| | |
|---|---|
| ***E21B 34/06*** | (2006.01) |
| ***E21B 34/08*** | (2006.01) |
| ***E21B 34/10*** | (2006.01) |
| ***E21B 34/14*** | (2006.01) |
| ***E21B 43/20*** | (2006.01) |
| *E21B 33/12* | (2006.01) |

(52) U.S. Cl.

CPC ..... *E21B 34/14* (2013.01); *E21B 34/06* (2013.01); *E21B 34/08* (2013.01); *E21B 34/10* (2013.01); *E21B 43/20* (2013.01); *E21B 33/12* (2013.01); *E21B 2200/04* (2020.05); *E21B 2200/06* (2020.05)

(58) Field of Classification Search

CPC ..... E21B 34/06; E21B 34/08; E21B 34/10; E21B 34/14; E21B 43/20

See application file for complete search history.

(56) References Cited

U.S. PATENT DOCUMENTS 4,220,176 A * 9/1980 Russell ..... E21B 21/10 137/496

4,393,930 A 7/1983 Ross et al.

(Continued)

FOREIGN PATENT DOCUMENTS

WO 2016191584 A1 12/2016

*Primary Examiner* — Matthew R Buck

(74) *Attorney, Agent, or Firm* — Kelly McKinney

(57) ABSTRACT

A technique facilitates injection via an injector well while providing automatic restriction of unwanted back flow. A completion positioned in a borehole facilitates the injection operation. The completion includes a packer coupled with a tubing and oriented to enable formation of a seal between the tubing and a surrounding casing. A formation isolation valve is coupled to the tubing. Additionally, a mechanical assembly is coupled to the tubing at, for example, a location below the formation isolation valve. The mechanical assembly may include a mechanical formation isolation valve and a flow controller. The flow controller is automatically actuatable to enable a flow of injection fluid in a downhole direction while blocking fluid flow in an uphole direction while the mechanical formation isolation valve is in a closed position. The flow controller includes a plurality of flow restrictors positioned to control flow between an interior and an exterior of the tubing.

4 Claims, 10 Drawing Sheets

(56) References Cited

U.S. PATENT DOCUMENTS

| | | | | |
|---|---|---|---|---|
| 4,846,221 | A * | 7/1989 | Kanemaru | F16K 5/0605 137/614.17 |
| 5,529,126 | A | 6/1996 | Edwards | |
| 6,354,378 | B1 * | 3/2002 | Patel | E21B 21/103 166/321 |
| 7,090,020 | B2 * | 8/2006 | Hill | E21B 23/006 166/373 |
| 7,849,925 | B2 | 12/2010 | Patel | |
| 7,950,454 | B2 * | 5/2011 | Patel | E21B 43/045 166/278 |
| 8,408,314 | B2 | 4/2013 | Patel et al. | |
| 9,222,334 | B2 * | 12/2015 | Erkol | E21B 34/06 |
| 2002/0066573 | A1 | 6/2002 | Patel | |
| 2006/0162932 | A1 | 7/2006 | McCalvin | |
| 2007/0187107 | A1 | 8/2007 | Pringle | |
| 2009/0071651 | A1 | 3/2009 | Patel | |
| 2011/0079382 | A1 | 4/2011 | Patel | |
| 2012/0199365 | A1 | 8/2012 | Patel et al. | |
| 2012/0205114 | A1 | 8/2012 | Biddick et al. | |
| 2014/0083689 | A1 | 3/2014 | Streich et al. | |
| 2014/0332224 | A1 * | 11/2014 | Pogoson | E21B 33/129 166/359 |
| 2017/0292347 | A1 | 10/2017 | Mailand et al. | |
| 2017/0356272 | A1 | 12/2017 | Pinard et al. | |

* cited by examiner

BACK FLOW RESTRICTION SYSTEM AND METHODOLOGY FOR INJECTION WELL

CROSS-REFERENCE TO RELATED APPLICATION

The present document is based on and claims priory to U.S. Provisional Application Ser. No. 62/617,926, filed Jan. 16, 2018, which is incorporated herein by reference in its entirety.

BACKGROUND

In many hydrocarbon well applications, water injection is used to facilitate production of hydrocarbon fluids. A completion is deployed downhole in a borehole and is configured to enable water injection into the surrounding formation while restricting back flow of water up through the completion if the water injection is shut down. One type of back flow restriction system used in the completion comprises a flow isolation valve located below a combined flapper valve and removable choke. The flow isolation valve may be in the form of a ball valve which may be actuated by pressure pulses or other actuation mechanisms. If the ball valve does not actuate, a shifting tool may be run downhole and engaged with the ball valve. However, use of the shifting tool involves removing the removable choke via an expensive and time-consuming separate run downhole. Additionally, when the shifting tool is run down through the flapper valve it can sometimes get hung up during retrieval back through the flapper valve.

SUMMARY

In general, a system and methodology are provided which facilitate injection, e.g. water injection, via an injector well while providing automatic restriction of unwanted back flow. According to an embodiment, a completion is positioned in a borehole to facilitate the injection operation. The completion comprises a packer coupled with a tubing. The packer is oriented to enable formation of a seal between the tubing and a surrounding casing. A flow isolation valve is coupled to the tubing for control of fluid flow along the tubing. Additionally, a mechanical assembly is coupled to the tubing at, for example, a location below the formation isolation valve. The mechanical assembly may comprise a tubing closure member, e.g. a mechanical formation isolation valve or a nipple and plug assembly, and a flow controller. The flow controller is automatically actuatable to enable a flow of injection fluid in a downhole direction while blocking fluid flow in an uphole direction while the tubing closure member is in a closed position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The present disclosure generally relates to a system and methodology which facilitate injection, e.g. water injection, via an injector well while providing automatic restriction of unwanted back flow. According to an embodiment, a completion is positioned in a borehole to facilitate the injection operation. The completion comprises features which facilitate controlled injection of water or other injection fluids into a surrounding formation. Additionally, the completion comprises features which automatically prevent back flow of fluid up through the completion when the injection operation is shut down, e.g. interrupted/stopped.

In various embodiments, the completion may comprise a packer coupled with a tubing. The packer is oriented to enable formation of a seal between the tubing and a surrounding casing. A flow isolation valve is coupled to the tubing for control of fluid flow along the tubing. Additionally, a mechanical assembly is coupled to the tubing at a suitable location, e.g. a location below the formation isolation valve. The mechanical assembly may comprise a tubing closure member and a flow controller. Examples of tubing closure members include a mechanical formation isolation valve and a nipple and plug assembly. The flow controller may have various configurations and is automatically actuatable to enable a flow of injection fluid in a downhole direction while blocking back flow of fluid in an uphole direction while the tubing closure member is in a closed position.

Figure 1:
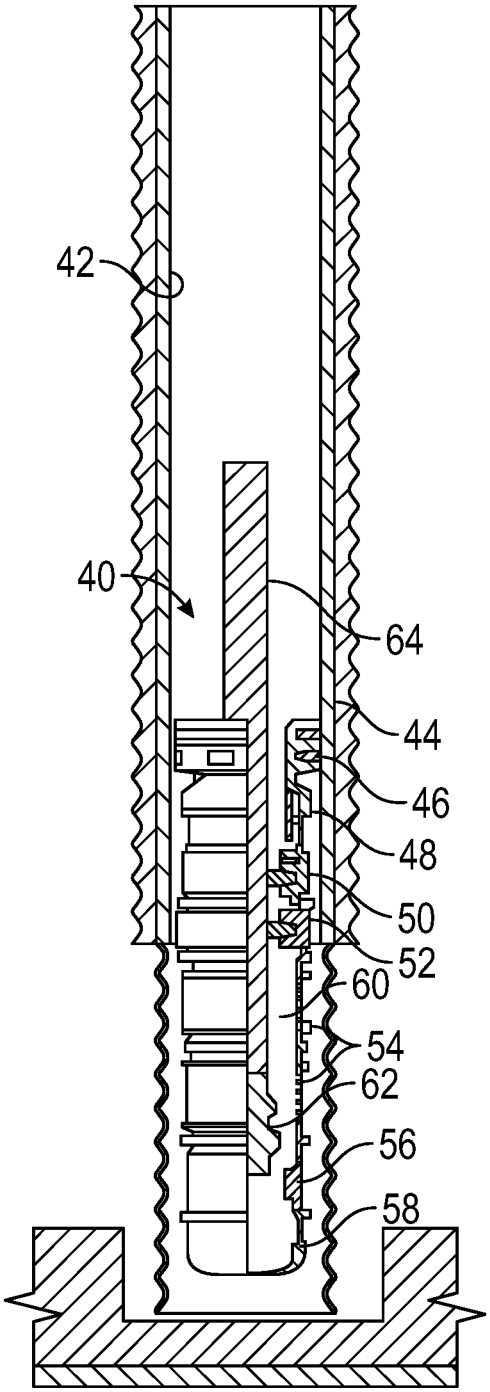
FIG. 1 is a schematic illustration of a downhole completion comprising an example of a formation isolation valve and a mechanical assembly having a flow controller, according to an embodiment of the disclosure.

Referring generally to FIG. 1, an example of a downhole completion 40 is illustrated as positioned in a borehole 42 to facilitate injection, e.g. water injection, into a surrounding formation. In this example, the downhole completion 40 is in the form of a lower completion deployed down through a casing 44. The completion 40 may comprise a variety of components depending on the parameters of a given downhole operation. The illustrated example of completion 40 comprises a packer 46, a blank pipe extension 48, a formation isolation valve 50, a mechanical assembly 52, a plurality of sand screens 54, a polished bore receptacle 56 and/or various other components 58.

Figure 2:
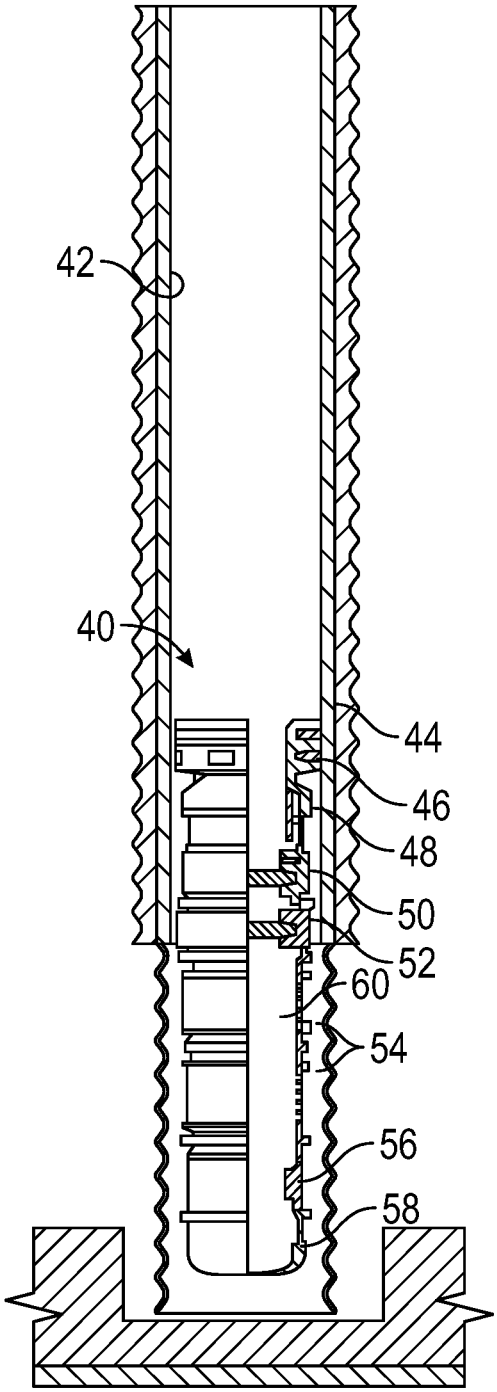
FIG. 2 is a schematic illustration similar to that of FIG. 1 but in a different operational position, according to an embodiment of the disclosure.

As explained in greater detail below, the formation isolation valve 50 and the mechanical assembly 52 work in cooperation to control flow along an interior 60 of the completion 40. The mechanical assembly 52 may comprise various features such as a mechanical formation isolation valve and flow controller to enable injection of fluid while automatically restricting back flow of fluid up along interior 60. In the example illustrated, a shifting tool 62 is illustrated as deployed on a wash pipe 64 for actuation of components such as formation isolation valve 50 and mechanical assembly 52. For example, the shifting tool 62 may be used to close the mechanical assembly 52 and the formation isolation valve 50 and then pulled out of hole, as illustrated in FIG. 2.

Figure 3:
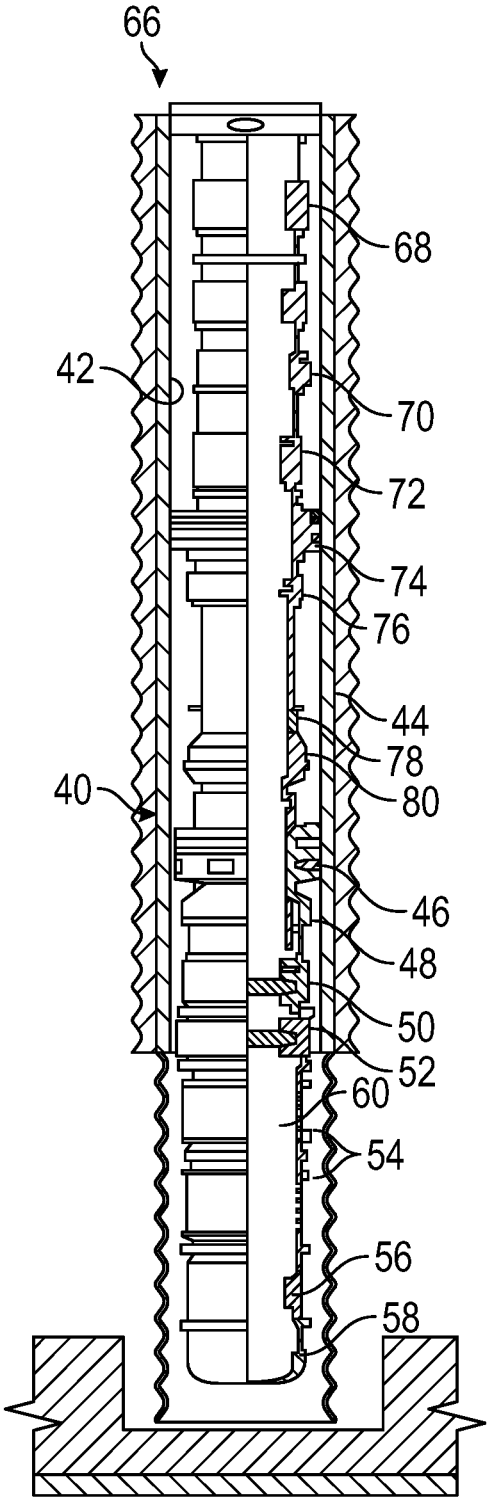
FIG. 3 is a schematic illustration of the downhole completion combined with an upper completion, according to an embodiment of the disclosure.

Subsequently, an upper completion 66 may be run downhole into borehole 42 and landed on downhole completion 40, e.g. the lower completion, as illustrated in FIG. 3. The upper completion 66 also may comprise many types of components depending on the parameters of a given operation. By way of example, the upper completion 66 may comprise a safety valve 68, a gauge mandrel 70, an annular release polished bore receptacle 72, a production packer 74, a profile nipple 76, a perforated pup joint 78, and a no-go locator 80. It should be noted, however, the components of the upper completion 66 and lower completion 40 are provided as examples and should not be construed as limiting.

Figure 4:
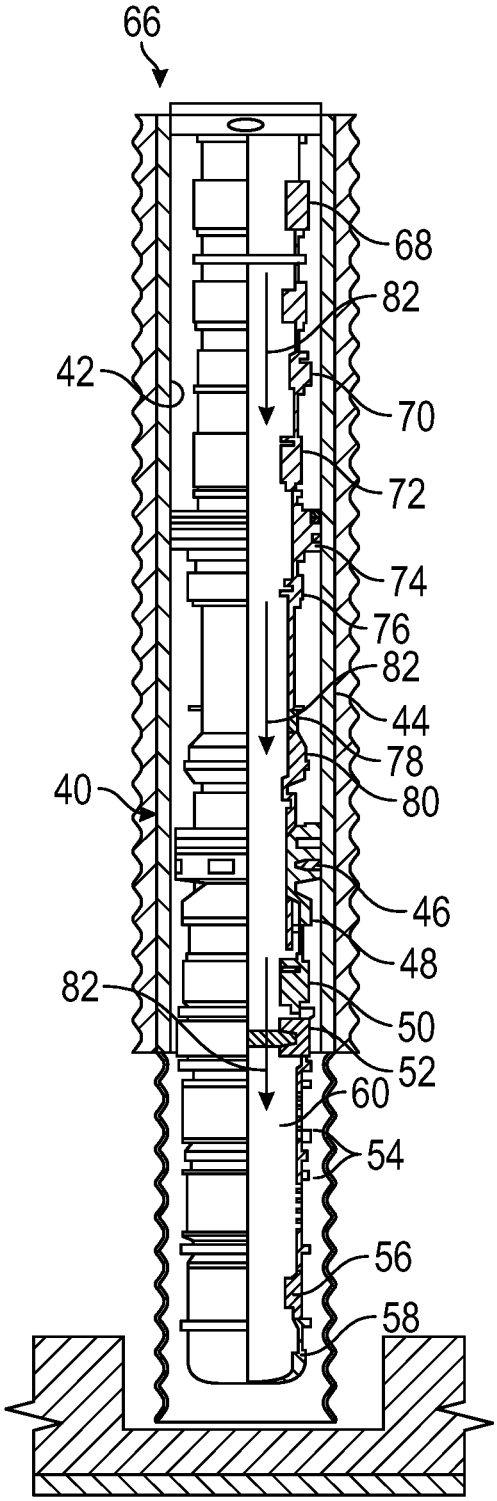
FIG. 4 is a schematic illustration similar to that of FIG. 3 but in a different operational position, according to an embodiment of the disclosure.

Once the upper completion 66 is engaged with the lower completion 40, the formation isolation valve 50 may be opened and injection of water (or other suitable injection fluid) may be initiated, as illustrated in FIG. 4. The injection fluid may be delivered downhole under pressure through completion interior 60 and into the surrounding formation, as represented by arrows 82.

Figure 5:
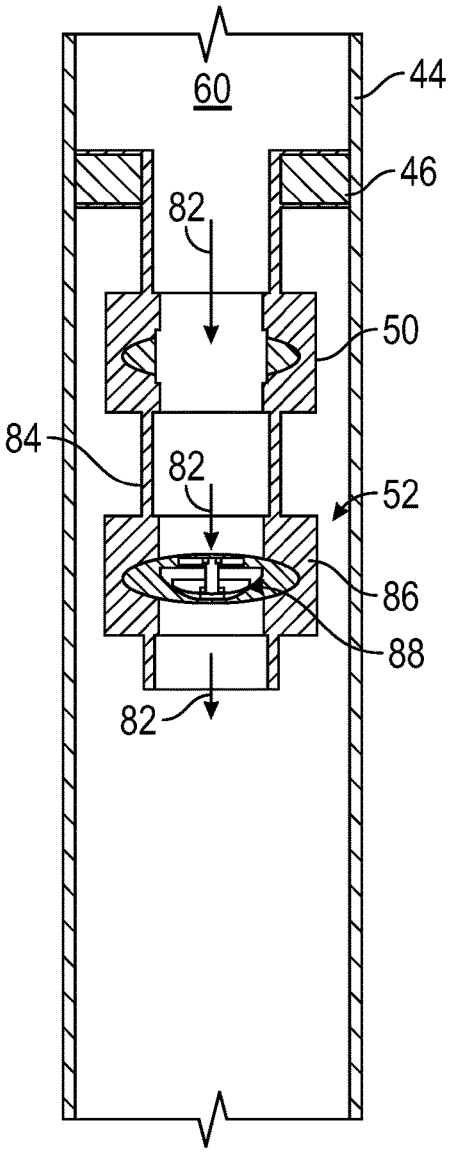
FIG. 5 is a schematic illustration of an example of a formation isolation valve combined with a mechanical assembly having a flow controller, according to an embodiment of the disclosure.

Referring generally to FIG. 5, an example of a portion of completion 40 is illustrated. In this embodiment, the formation isolation valve 50 is illustrated as positioned along and coupled with a tubing 84. By way of example, the formation isolation valve 50 may be in the form of a ball valve. Additionally, the mechanical assembly 52 is positioned along and coupled with tubing 84 at a location beneath the formation isolation valve 50. The packer 46 also may be coupled with the tubing 84 and oriented to enable formation of a seal between the tubing 84 and the surrounding casing 44.

Figure 6:
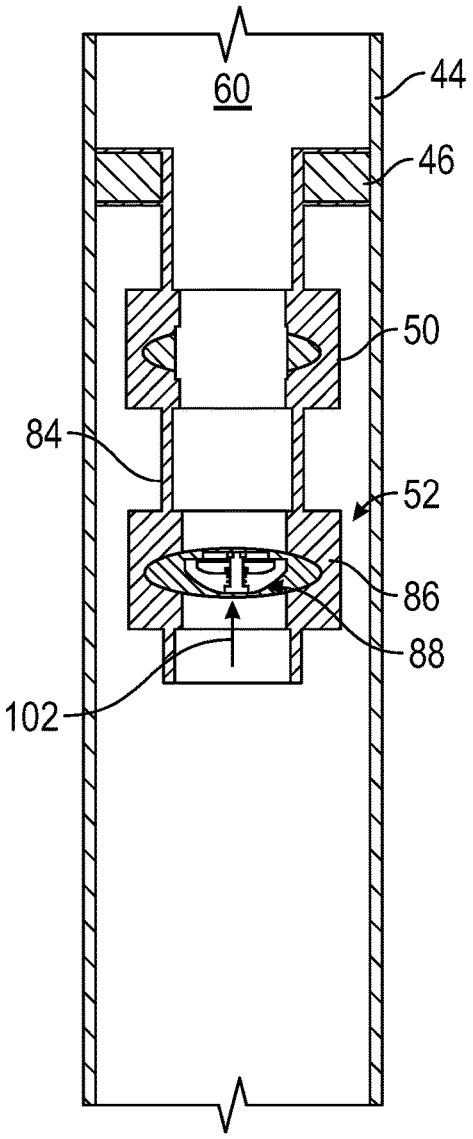
FIG. 6 is a schematic illustration similar to that of FIG. 5 but in a different operational position, according to an embodiment of the disclosure.

By way of example, the mechanical assembly 52 may comprise a tubing closure member 86 combined with a flow controller 88. The tubing closure member 86 may be in the form of a mechanical formation isolation valve. In the illustrated example, the mechanical formation isolation valve 86 may be actuated between a closed position and an open position with respect to flow along interior 60 through tubing 84. However, the flow controller 88 serves as a flow restrictor which allows flow of injection fluid 82 even when the mechanical formation isolation valve 86 is in a closed position, as illustrated in FIG. 5. However, the flow controller 88 automatically actuates to a closed position blocking fluid flow in an uphole direction when the injection operation is interrupted or otherwise stopped, as illustrated in FIG. 6.

Figure 7:
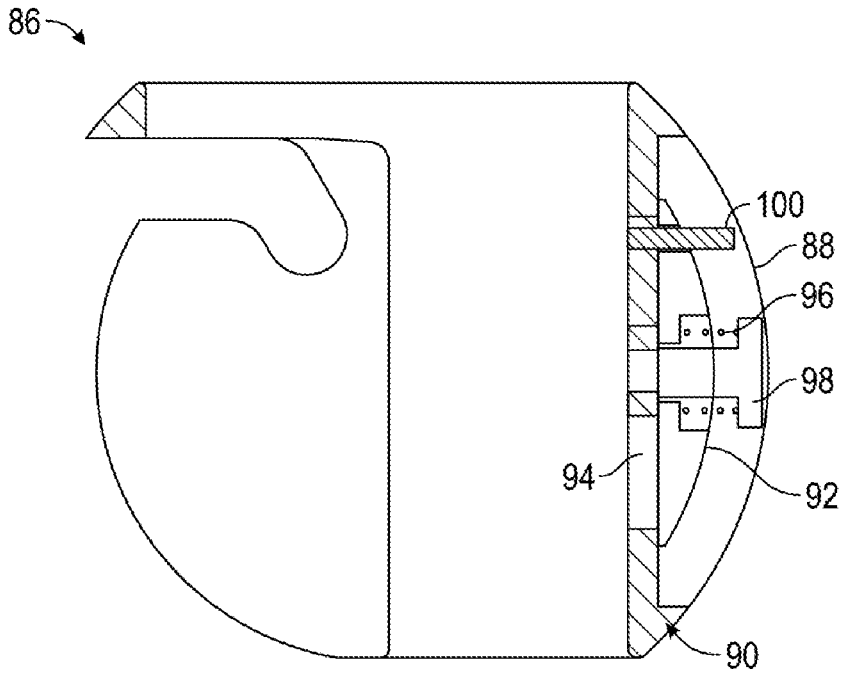
FIG. 7 is a schematic illustration of an example of a combined mechanical assembly and flow controller which cooperate to enable an injection fluid flow and to automatically block back flow, according to an embodiment of the disclosure.

Referring generally to FIG. 7, an example of mechanical assembly 52 is illustrated. In this example, the mechanical formation isolation valve 86 is in the form of a ball valve 90 which may be actuated between an open position and a closed position. For example, the completion 40 may be run in hole with the ball valve 90 in an open position freely allowing flow along interior 60. Once the completion 40 is positioned downhole, the ball valve 90 may be shifted via shifting tool 62 to a closed position, as illustrated in FIG. 7.

Figure 8:
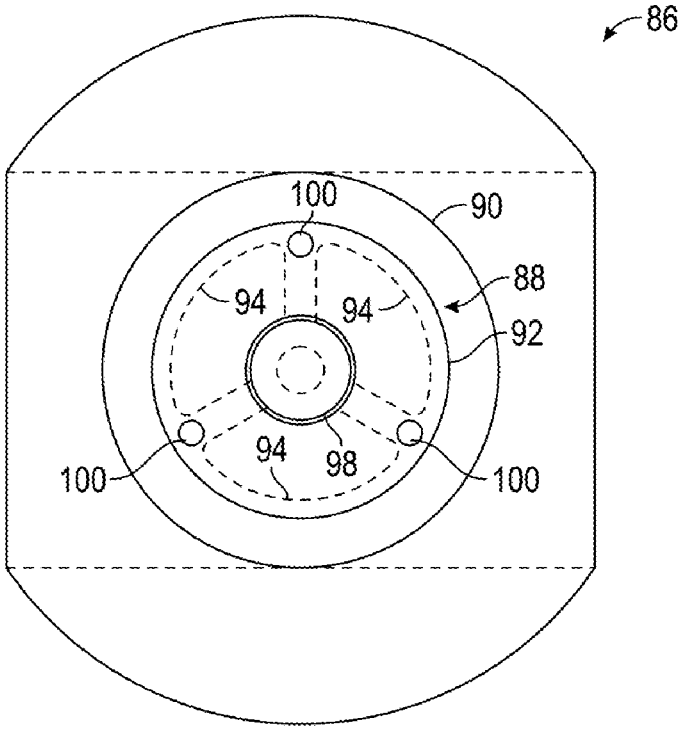
FIG. 8 is a schematic illustration showing another view of the combined mechanical assembly and flow controller illustrated in FIG. 7, according to an embodiment of the disclosure.

In this example, the flow controller 88 comprises a disk flow restrictor having a disk 92 which works in cooperation with an opening or openings 94 through the ball of ball valve 90. The disk 92 may be biased to a closed position via a spring 96, e.g. a coil spring, acting between the disk 92 and a corresponding disk retaining feature 98, e.g. a disk retaining bolt. As further illustrated in FIG. 8, a plurality of guide pins 100 may be used to ensure desired movement of disk 92 during opening and closing of the disk 92 with respect to openings 94.

Figure 9:
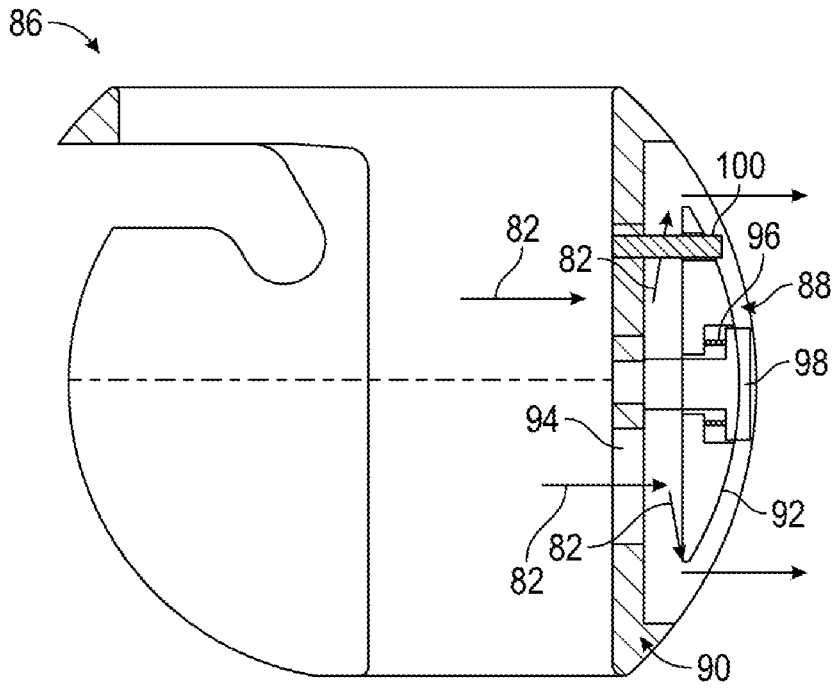
FIG. 9 is a schematic illustration similar to that of FIG. 7 but in a different operational position, according to an embodiment of the disclosure.
Figure 10:
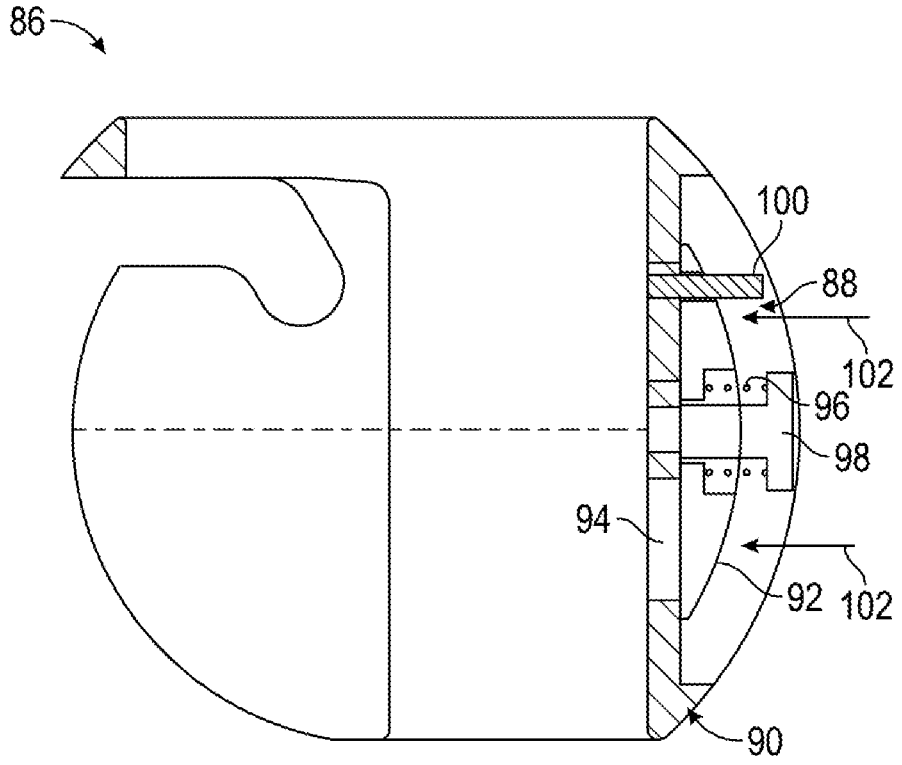
FIG. 10 is a schematic illustration similar to that of FIG. 9 but in a different operational position, according to an embodiment of the disclosure.

As illustrated in FIG. 9, the pressure of injection fluid 82 causes the disk 92 to shift along guide pins 100 against the bias of spring 96. Effectively, the flow controller 88 is shifted to the open flow position via the pressure, thus allowing injection of water or other injection fluid 82 while valve 86, e.g. ball valve 90, remains in the closed position. However, if the flow of injection fluid 82 is interrupted, e.g. stopped, the force exerted by spring 96 as well as the pressure of any back flowing fluid, represented by arrows 102, causes the disk 92 and thus flow controller 88 to shift to the closed position, as illustrated in FIG. 10.

Figure 11:
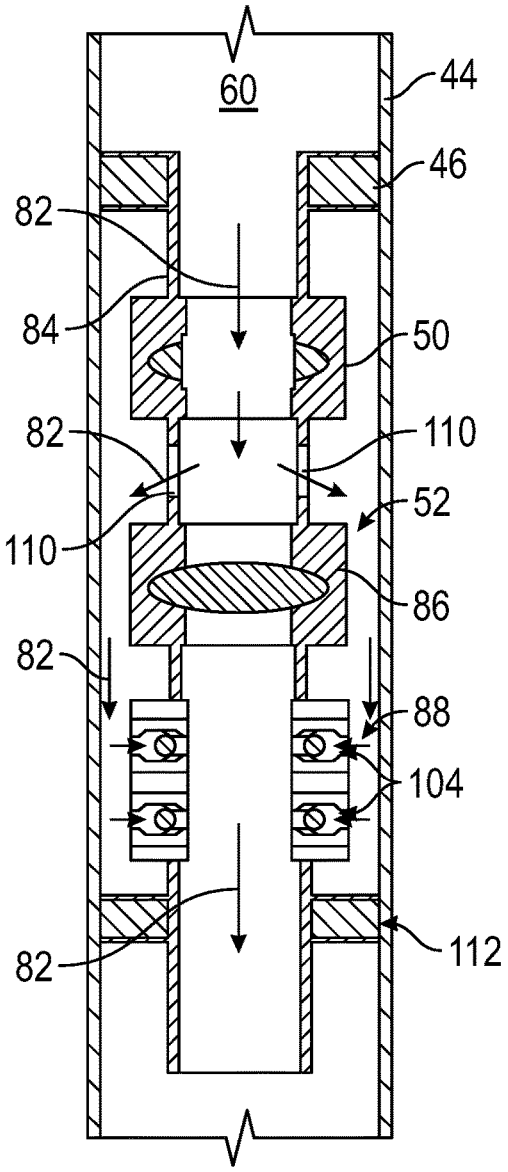
FIG. 11 is a schematic illustration of another example of a formation isolation valve combined with a mechanical assembly having a flow controller, according to an embodiment of the disclosure.
Figure 12:
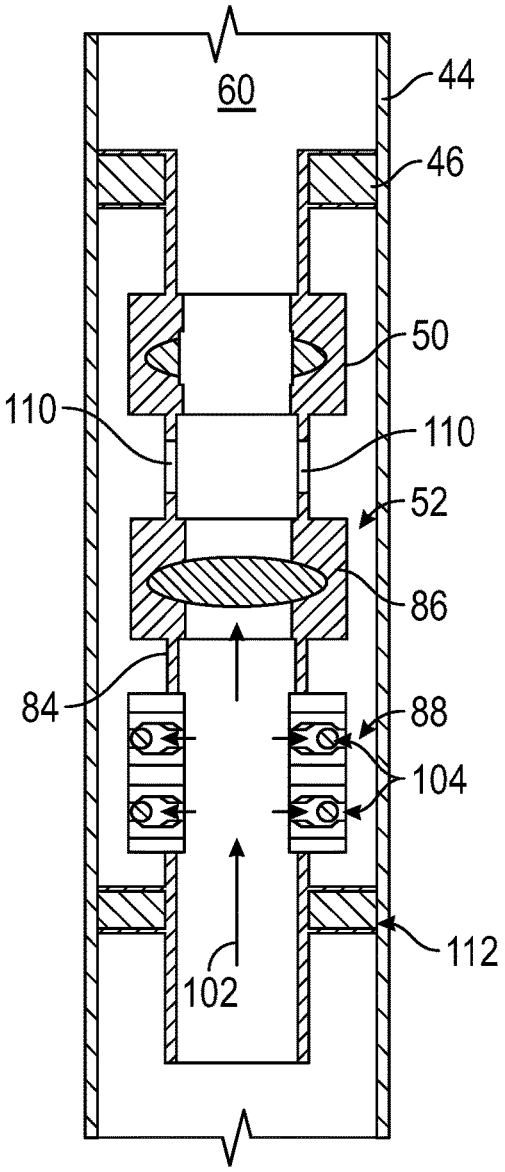
FIG. 12 is a schematic illustration similar to that of FIG. 11 but in a different operational position, according to an embodiment of the disclosure.

Referring generally to FIGS. 11 and 12, another embodiment is illustrated in which the formation isolation valve 50 and mechanical assembly 52 are deployed along tubing 84. In this example, the mechanical assembly 52 may again comprise mechanical formation isolation valve 86 combined with flow controller 88. The mechanical formation isolation valve 86 may similarly be actuated between a closed position and an open position with respect to flow along interior 60 through tubing 84. The flow controller 88 again serves as a flow restrictor which allows flow of injection fluid 82 even when the mechanical formation isolation valve 86 is in a closed position, as illustrated in FIG. 11. However, the flow controller 88 automatically actuates to a closed position blocking fluid flow in an uphole direction when the injection operation is interrupted or otherwise stopped, as illustrated in FIG. 12.

In this embodiment, the mechanical formation isolation valve 86 may again be in the form of ball valve 90 which may be actuated between an open position and a closed position. However, the flow controller 88 has a different configuration and utilizes a plurality of flow restrictors 104 positioned about tubing 84 in one or more layers. The flow restrictors 104 may be constructed as balls 106 contained in chambers 108, as further illustrated in FIGS. 13 and 14.

Figure 13:
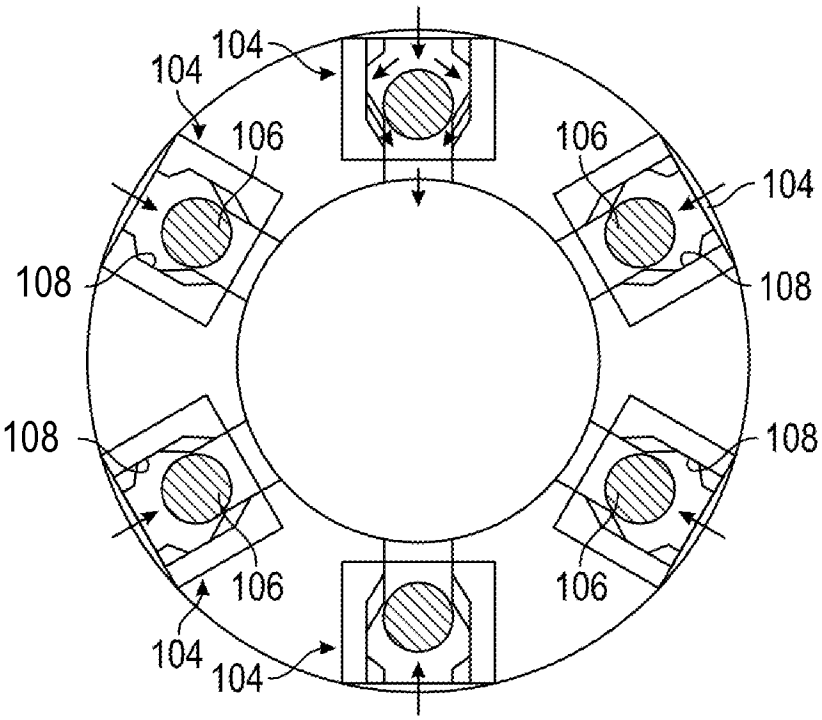
FIG. 13 is a schematic illustration of an example of a flow controller utilizing a plurality of flow restrictors, according to an embodiment of the disclosure.

During injection, injection fluid 82 flows down through the interior 60 (which continues along the interior of tubing 84). The injection fluid 82 flows past open formation isolation valve 50 and laterally out of tubing 84 through openings 110. The injection fluid 82 flows around the exterior of mechanical formation isolation valve 86 and back into the interior of tubing 84 through flow restrictors 104, as illustrated in FIGS. 11 and 13. A lower packer 112 may be positioned between tubing 84 and the surrounding casing 44 at a location below flow restrictors 104 so as to prevent further travel of the injection fluid 82 along the annulus between tubing 84 and casing 44.

Figure 14:
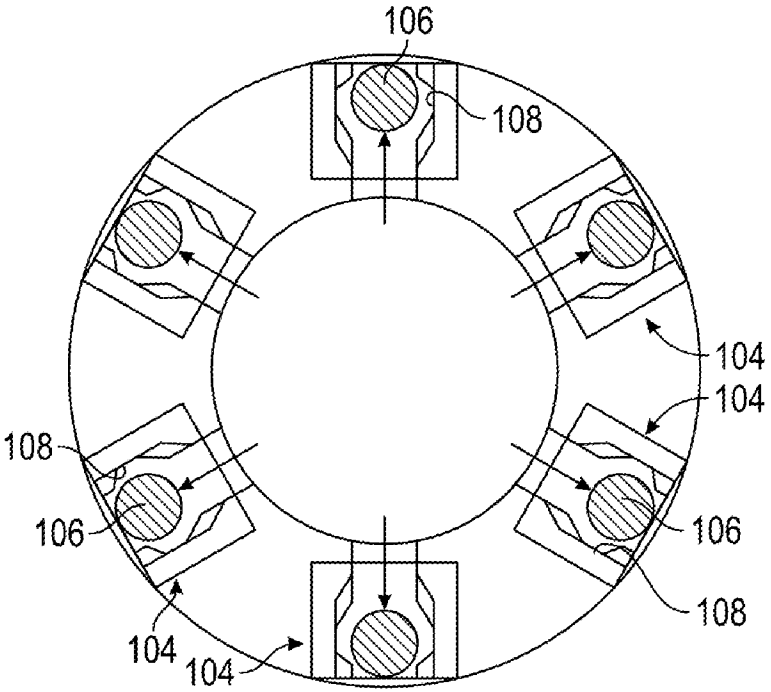
FIG. 14 is a schematic illustration similar to that of FIG. 13 but in a different operational position, according to an embodiment of the disclosure.

If flow of injection fluid 82 is interrupted, e.g. stopped, the flow restrictors 104 prevent the back flow of fluid from the interior of tubing 84 to an exterior. In this example, the back flowing fluid 102 moves the balls 106 to seated positions in chambers 108, thus preventing further flow therethrough in the back flow direction. Consequently, back flow of fluid 102 is prevented by flow restrictors 104 and the closed mechanical formation isolation valve 86, as illustrated in FIGS. 12 and 14.

Figure 15:
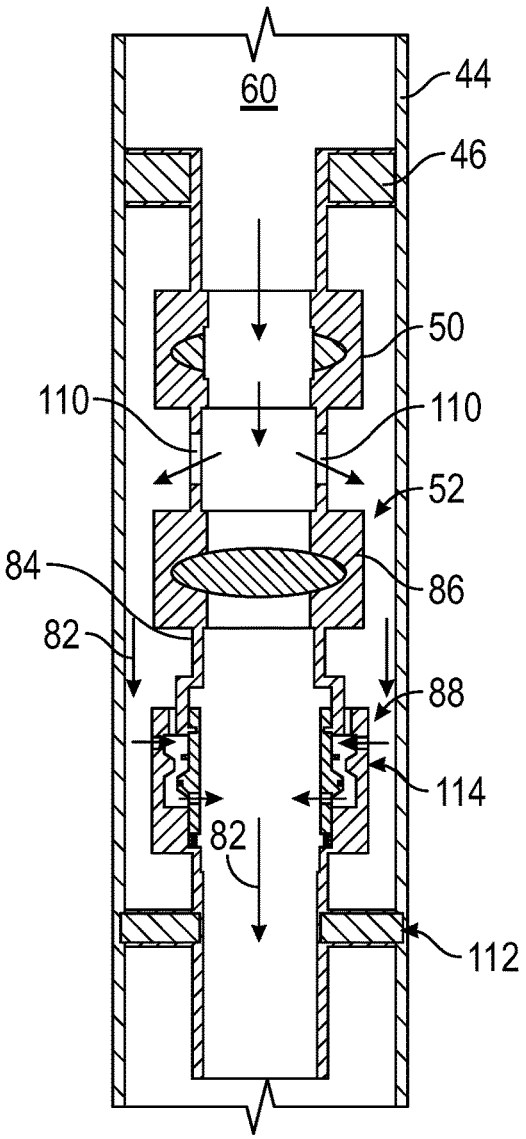
FIG. 15 is a schematic illustration of another example of a formation isolation valve combined with a mechanical assembly having a flow controller, according to an embodiment of the disclosure.
Figure 16:
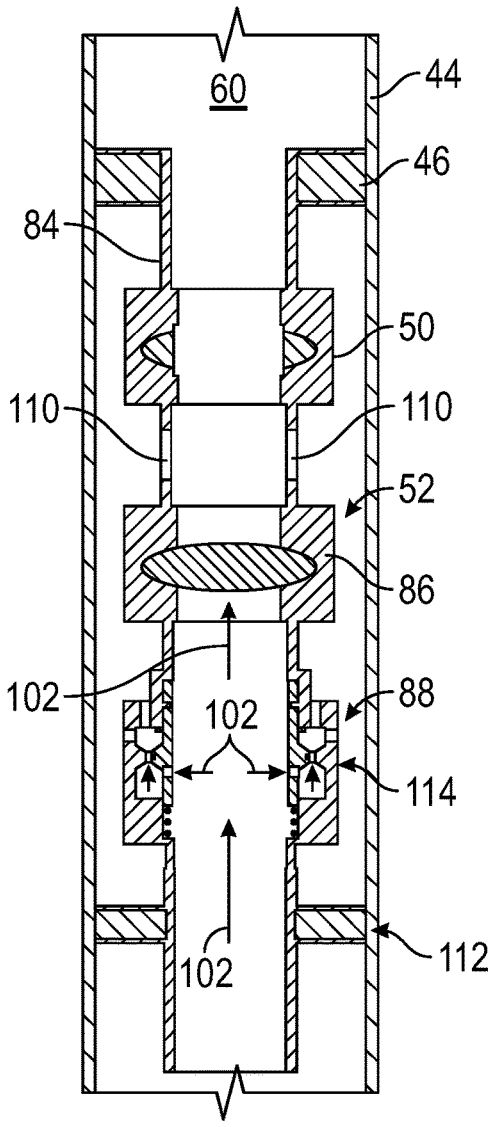
FIG. 16 is a schematic illustration similar to that of FIG. 15 but in a different operational position, according to an embodiment of the disclosure.

Referring generally to FIGS. 15 and 16, another embodiment is illustrated in which the formation isolation valve 50 and mechanical assembly 52 are again deployed along tubing 84. In this example, the mechanical assembly 52 may again comprise mechanical formation isolation valve 86 combined with flow controller 88. The mechanical formation isolation valve 86 may similarly be actuated between a closed position and an open position with respect to flow along interior 60 through tubing 84. The flow controller 88 again serves as a flow restrictor which allows flow of injection fluid 82 even when the mechanical formation isolation valve 86 is in a closed position, as illustrated in FIG. 15. However, the flow controller 88 automatically actuates to a closed position blocking fluid flow in an uphole direction when the injection operation is interrupted or otherwise stopped, as illustrated in FIG. 16.

In this embodiment, the mechanical formation isolation valve 86 may again be in the form of ball valve 90 which may be actuated between an open position and a closed position. However, the flow controller 88 has a different configuration and utilizes an inline flow restrictor 114 positioned along tubing 84. The inline flow restrictor 114 may be constructed with a shiftable mandrel 116 contained in a mandrel housing 118, as further illustrated in FIGS. 17 and 18.

Figure 17:
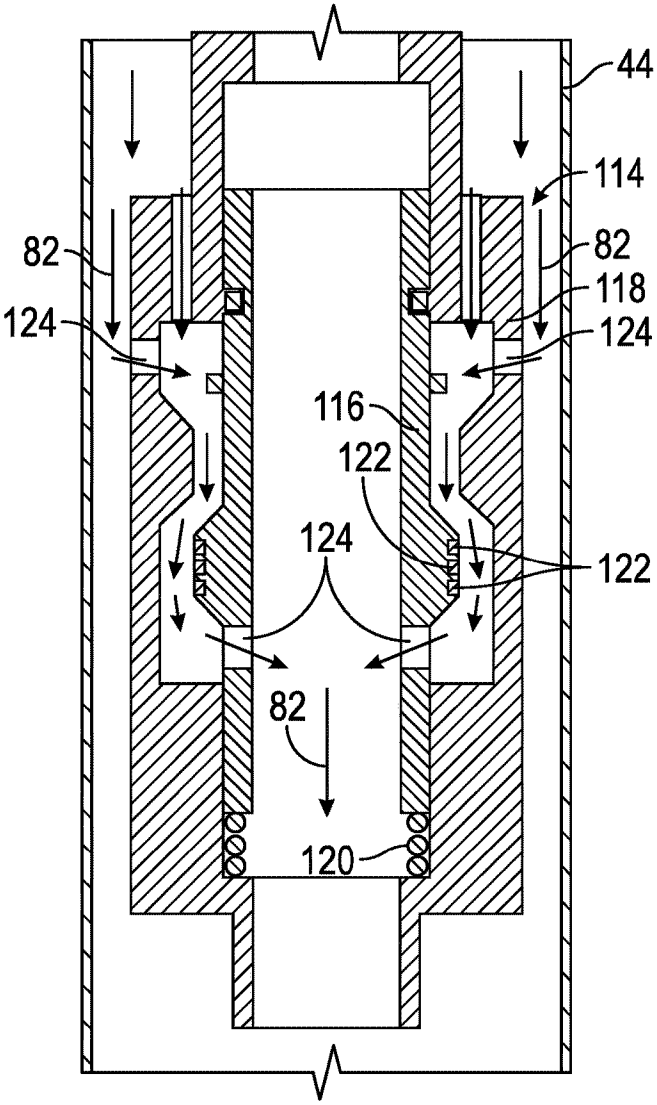
FIG. 17 is a schematic illustration of another example of a flow controller utilizing an inline flow restrictor having a shiftable mandrel, according to an embodiment of the disclosure.

During injection, injection fluid 82 flows down through the interior 60 and thus along the interior of tubing 84. The injection fluid 82 flows past open formation isolation valve 50 and laterally out of tubing 84 through openings 110. The injection fluid 82 flows around the exterior of mechanical formation isolation valve 86 and back into the interior of tubing 84 through inline flow restrictor 114, as illustrated in FIGS. 15 and 17. Lower packer 112 is positioned between tubing 84 and the surrounding casing 44 at a location below inline flow restrictor 114 so as to prevent further travel of the injection fluid 82 along the annulus between tubing 84 and casing 44.

Figure 18:
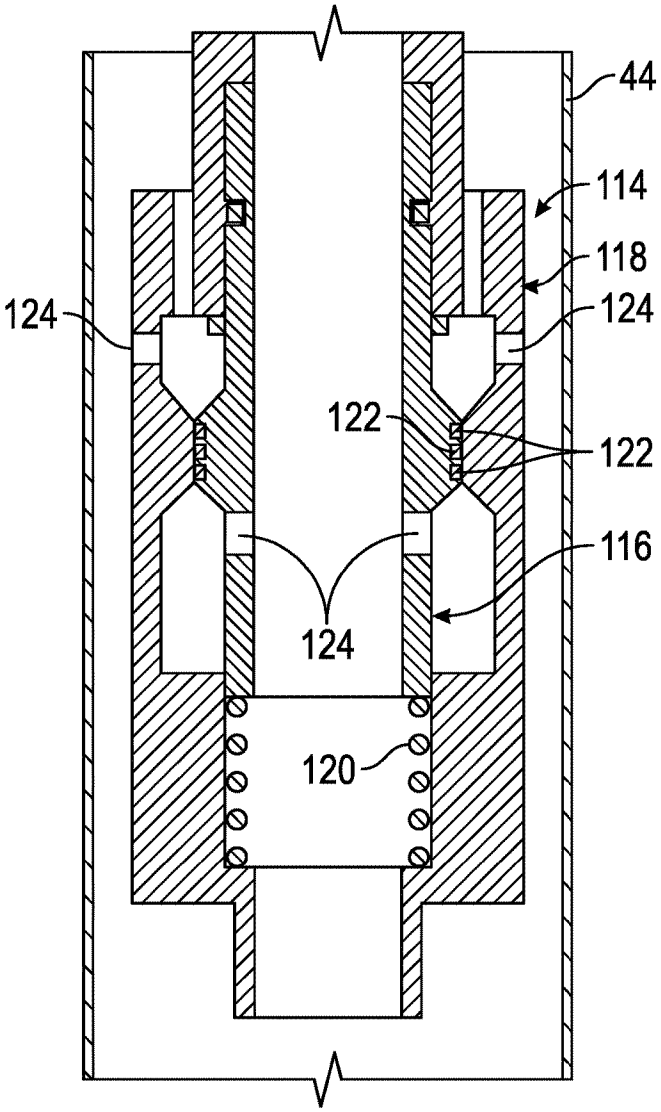
FIG. 18 is a schematic illustration similar to that of FIG. 17 but in a different operational position, according to an embodiment of the disclosure.

If flow of injection fluid 82 is interrupted, e.g. stopped, the inline flow restrictor 114 prevents the back flow of fluid 102 from the interior of tubing 84 to an exterior. Consequently, back flow of fluid 102 is prevented by inline flow restrictor 114 and the closed mechanical formation isolation valve 86, as illustrated in FIGS. 16 and 18. By way of example, the shiftable mandrel 116 may be spring biased via a spring 120 toward a closed position in which a mandrel seal or seals 122 are moved into engagement with a corresponding seal surface of mandrel housing 118. Appropriate passages 124 may be formed laterally through shiftable mandrel 116 and mandrel housing 118 to facilitate flow of the injection fluid 82 back into the interior of tubing 84 during flow of injection fluid 82.

Figure 19:
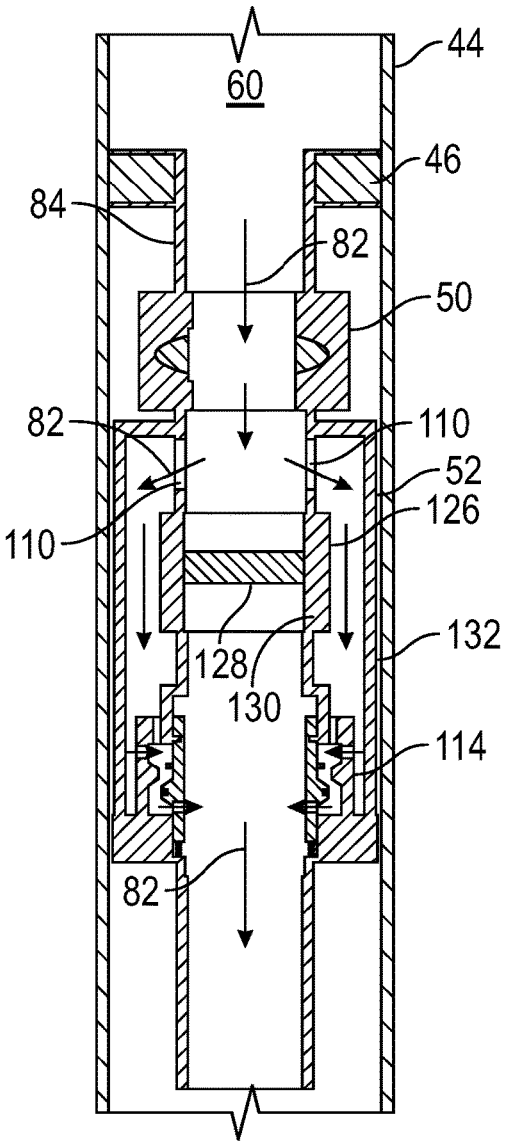
FIG. 19 is a schematic illustration of another example of a formation isolation valve combined with a mechanical assembly having a flow controller, according to an embodiment of the disclosure.
Figure 20:
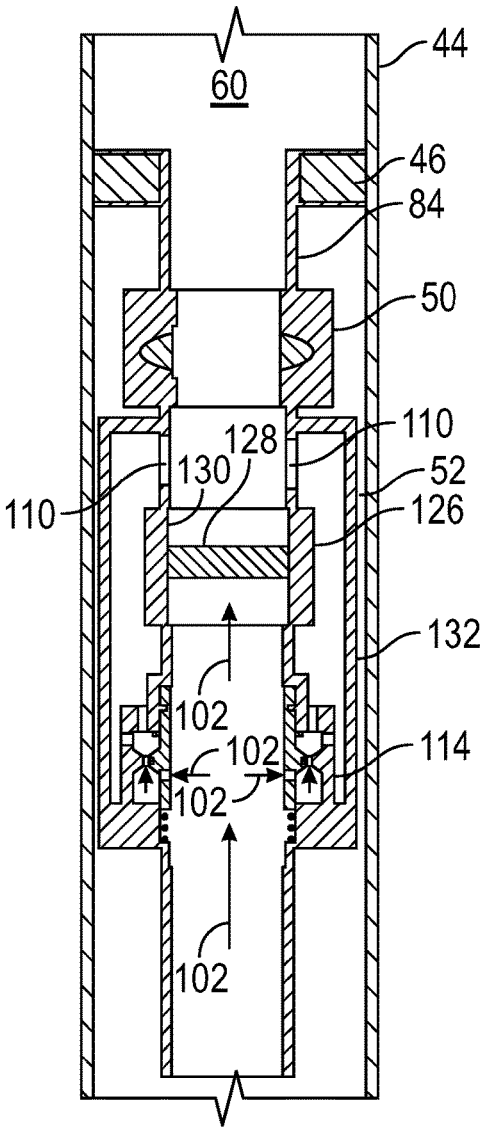
FIG. 20 is a schematic illustration similar to that of FIG. 19 but in a different operational position, according to an embodiment of the disclosure.

Referring generally to FIGS. 19 and 20, another embodiment is illustrated in which the formation isolation valve 50 and mechanical assembly 52 are again deployed along tubing 84. In this example, the mechanical assembly 52 comprises a nipple and plug assembly 126. The nipple and plug assembly 126 comprises a plug 128 removably positioned in a corresponding nipple 130 so as to block flow therethrough. The plug 128 may be delivered downhole via a suitable tool after the completion 40 is run in hole.

In this embodiment, the flow controller 88 again serves as a flow restrictor which allows flow of injection fluid 82 even when flow is blocked by a plug 128, as illustrated in FIG. 19. However, the flow controller 88 automatically actuates to a closed position blocking fluid flow in an uphole direction when the injection operation is interrupted or otherwise stopped, as illustrated in FIG. 20. As illustrated, the flow controller 88 may again be in the form of inline flow restrictor 114 positioned along tubing 84. However, instead of using lower packer 112, a flow shroud 132 is positioned around the flow controller 88 and the nipple and plug assembly 126. The flow shroud 132 contains the flow of injection fluid 82 so that packer 112 may be omitted.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in an injection well, comprising:

a completion positioned in a borehole to facilitate injection, the completion comprising:

a packer coupled with a tubing, the packer being oriented to enable formation of a seal between the tubing and a surrounding casing;

a formation isolation valve coupled to the tubing; and a mechanical assembly coupled to the tubing below the formation isolation valve, the mechanical assembly comprising a mechanical formation isolation valve and a flow controller automatically actuatable to enable a flow of an injection fluid in a downhole direction while blocking fluid flow in an uphole direction while the mechanical formation isolation valve is in a closed position, wherein the flow controller comprises a plurality of flow restrictors positioned to control flow between an interior and an exterior of the tubing.

2. The system as recited in claim 1, wherein the completion further comprises an additional packer located below the flow restrictors and positioned to form a seal between the tubing and the surrounding casing.

3. A method comprising:

running a lower completion in a borehole, the lower completion comprising:

a packer coupled with a tubing, the packer being oriented to enable formation of a seal between the tubing and a surrounding casing;

a formation isolation valve coupled to the tubing; and a mechanical assembly coupled to the tubing below the formation isolation valve;

running an upper completion into the borehole above the lower completion and engaging the upper completion with the lower completion;

opening the formation isolation valve;

initiating injection of fluid under pressure through an interior of the lower completion and into a surrounding formation, wherein the mechanical assembly is automatically actuatable to enable a flow of the injection fluid in a downhole direction; and automatically actuating the mechanical assembly to a closed position blocking fluid flow in an uphole direction when the injection is interrupted or stopped, wherein the mechanical assembly comprises: a mechanical formation isolation valve; and a flow controller comprising a plurality of flow restrictors positioned to control flow between an interior and an exterior of the tubing.

4. The method of claim 3, wherein the lower completion further comprises an additional packer located below the plurality of flow restrictors and positioned to form a seal between the tubing and the surrounding casing.

* * * * *